US005190193A

United States Patent [19]

Scudday

[11] Patent Number: 5,190,193

[45] Date of Patent: Mar. 2, 1993

[54] CONTAINER CLOSURE

[76] Inventor: James D. Scudday, 2798 S. Syene Rd., Madison, Wis. 53711

[21] Appl. No.: 800,081

[22] Filed: Nov. 29, 1991

[51] Int. Cl.[5] ..... B65D 5/72; B65D 25/38

[52] U.S. Cl. ..... 222/500; 220/254; 222/480; 222/543; 222/562; 222/563; 222/564; 222/565

[58] Field of Search ..... 222/212, 213, 182, 322, 222/480, 500, 494–497, 545–547, 564, 559, 562, 563, 527; 220/254, 360, 375; 215/306

[56] References Cited

U.S. PATENT DOCUMENTS

| | | | |
|---|---|---|---|
| 2,181,335 | 11/1939 | Martin | 222/500 |
| 2,581,897 | 1/1952 | Allen | 222/500 X |
| 2,695,732 | 11/1954 | Tupper | 222/480 UX |
| 3,484,819 | 12/1969 | Tanner | 222/500 X |
| 3,618,825 | 11/1971 | Clarke | 222/494 X |
| 3,844,454 | 10/1974 | Buchtel | 222/500 X |
| 4,106,672 | 8/1978 | Tecco et al. | 222/565 X |

FOREIGN PATENT DOCUMENTS

| | | | |
|---|---|---|---|
| 2351988 | 5/1974 | Fed. Rep. of Germany | 222/500 |
| 477922 | 1/1938 | United Kingdom | 222/500 |
| 2053850 | 2/1981 | United Kingdom | 222/495 |

*Primary Examiner*—Kevin P. Shaver
*Attorney, Agent, or Firm*—Hugh E. Smith

[57] ABSTRACT

A container closure is mounted within a spout portion of an associated container, including a cylindrical head arranged for positioning upon a torroidal seat portion of the spout in a first position and displaced from the seat in a second position permitting fluid to flow thereabout, wherein the closure further includes a plurality of pairs of lobes mounted below the head portion of the closure preventing inadvertent removal of the closure from the container. A cap member is arranged for mounting to the spout to position the closure in the first position.

3 Claims, 4 Drawing Sheets

CONTAINER CLOSURE

BACKGROUND OF THE INVENTION

1. Field of the Invention

The field of invention relates to pouring spout apparatus, and more particularly pertains to a new and improved container closure wherein the same is arranged for the selective laminas flow of fluid from an associated container.

2. Description of the Prior Art

Fluid flow from containers of various types is available in the prior art, wherein the use of a closure to limit flow or to promote laminar flow from an associated container is desirable preventing the spillage from the containers during use. Prior art apparatus has been available to direct flow from a container wherein U.S. Pat. No. 4,850,566 to Riggert sets forth a squeezable closure arranged to direct flow from within a container through openings in the closure.

U.S. Pat. No. 4,420,101 to O'Neil sets forth a self-venting squeezable dispensing closure.

U.S. Pat. No. 4,162,749 to Bennett sets forth a squeezable closure arranged with a check ball for controlling fluid flow through the closure.

As such, it may be appreciated that there continues to be a need for a new and improved container closure as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of container closure apparatus now present in the prior art, the present invention provides a container closure wherein the same is arranged to provide for the selective fluid flow from a container utilizing a cap member to maintain an associated closure in a seated confrontation with a seat portion of an associated pouring spout. As such, the general purpose of the present invention, which will be described subsequently in greater detail, is to provide a new and improved container closure which has all the advantages of the prior art container closure apparatus and none of the disadvantages.

To attain this, the present invention provides a container closure mounted within a spout portion of an associated container, including a cylindrical head arranged for positioning upon a torroidal seat portion of the spout in a first position and displaced from the seat in a second position permitting fluid to flow thereabout, wherein the closure further includes a plurality of pairs of lobes mounted below the head portion of the closure preventing inadvertent removal of the closure from the container. A cap member is arranged for mounting to the spout to position the closure in the first position.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container closure which has all the advantages of the prior art container closure apparatus and none of the disadvantages.

It is another object of the present invention to provide a new and improved container closure which may be easily and efficiently manufactured and marketed.

It is a further object of the present invention to provide a new and improved container closure which is of a durable and reliable construction.

An even further object of the present invention is to provide a new and improved container closure which is susceptible of a low cost of manufacture with regard to both materials and labor, and which accordingly is then susceptible of low prices of sale to the consuming public, thereby making such container closures economically available to the buying public.

Still yet another object of the present invention is to provide a new and improved container closure which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
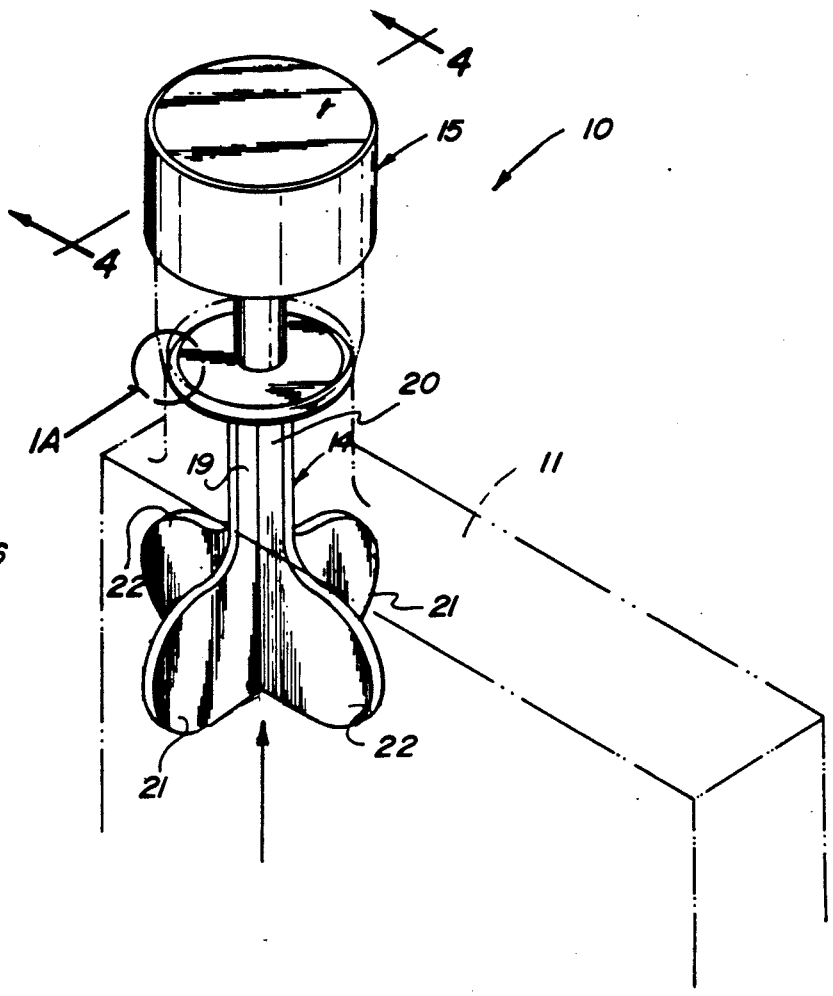
FIG. 1 is an isometric illustration of the instant invention.

With reference now to the drawings, and in particular to FIGS. 1 to 9 thereof, a new and improved container closure embodying the principles and concepts of the present invention and generally designated by the reference numeral 10 will be described.

Figure 1A:
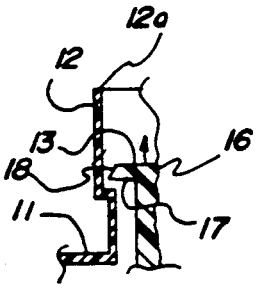
FIG. 1*a* is an orthographic cross-sectional view of section 1*a* as set forth in FIG. 1.
Figure 2:
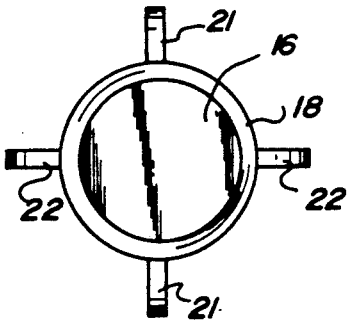
FIG. 2 is an orthographic top view of the closure member of the invention.
Figure 3:
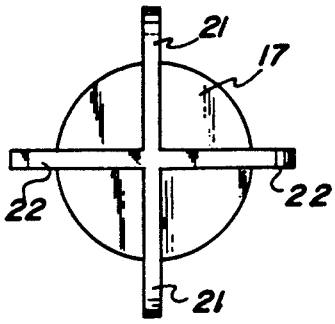
FIG. 3 is an orthographic bottom view of the closure member of the invention.
Figure 4:
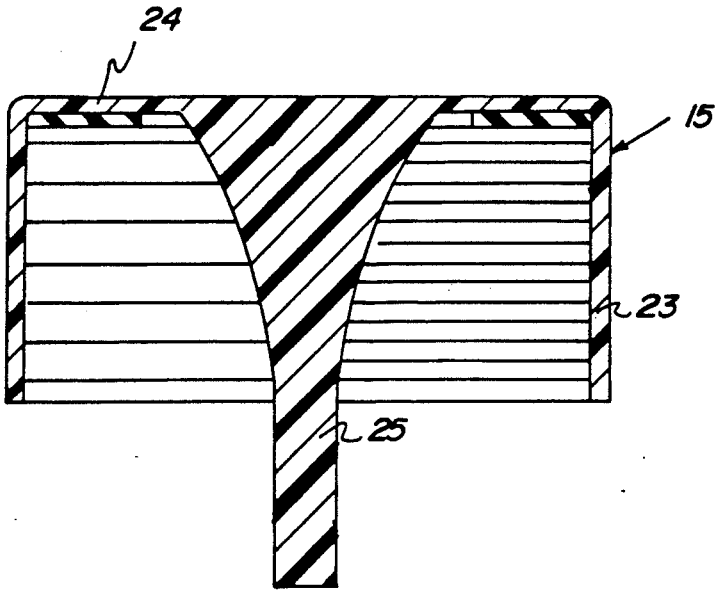
FIG. 4 is an orthographic view, taken along the lines 4—4 of FIG. 1 in the direction indicated by the arrows.

More specifically, the container closure 10 of the instant invention essentially comprises a container 11 including a container spout 12 terminating in a spout upper end 12*a*. The spout 12 includes a torroidal seat 13 below the spout upper end 12*a* and above the container 11, as illustrated in FIG. 1*a*. A closure member 14 is mounted within the spout, with its lower portion extending into the container 11, as illustrated in FIG. 1. The closure member 14 includes a cylindrical head 16 defined by a predetermined diameter, including a planar bottom surface 17, with a top surface terminating in a beveled top wall peripheral surface 18 to enhance fluid flow about the peripheral edge of the cylindrical head 16 during a pouring procedure when the closure member 14 is displaced from a first position on the torroidal seat 13 to a second position spaced therefrom. The closure member includes a closure member first vane 19 orthogonally oriented relative to a second vane 20 that are orthogonally and integrally mounted to the planar bottom surface 17 coaxially oriented relative to the cylindrical head 16 and defined by a predetermined width less than a predetermined diameter defined by the spout 12. A plurality of first coplanar lobes 21 are coplanar with the first vane 19 extending diametrically beyond opposed sides of the first vane coplanar therewith, and defined by a lobe diameter greater than the predetermined diameter of the spout 12. Similarly, second lobes 22 are coplanar relative to one another and the second vane 20 extending diametrically beyond opposed sides of the second vane adjacent the lower terminal end portion of the second vane, as illustrated in the FIG. 1 for example.

The container closure 10 further includes a spout cap 15 formed with a cylindrical head 23 including a cap top wall 24 orthogonally oriented relative to an axis defined by the cylindrical cap head, with a positioning leg 25 extending orthogonally downwardly and coaxially oriented relative to the cylindrical cap head 23 defined by a predetermined length substantially equal to a predetermined length extending from the spout upper end 12*a* to the top surface of the cylindrical head 16 to secure the closure member 14 into engagement with a seat during periods of non-use. It should be noted that the closure member 14 and the spout cap 15 are coaxially aligned relative to one another along a closure member axis 14*a* (see FIG. 5) when secured to the associated spout 12, wherein the closure member axis 14 is accordingly coincident with a spout axis defined by the container spout 12.

Figure 5:
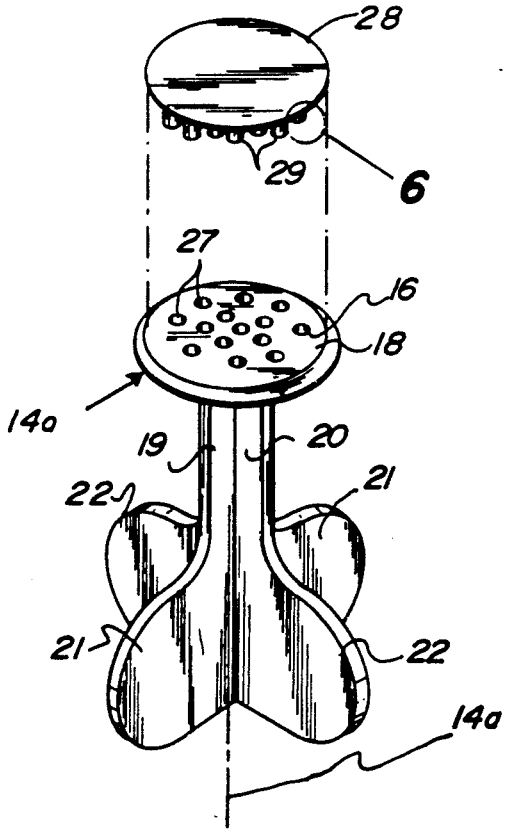
FIG. 5 is an isometric illustration of a modified closure member of the invention.
Figure 6:
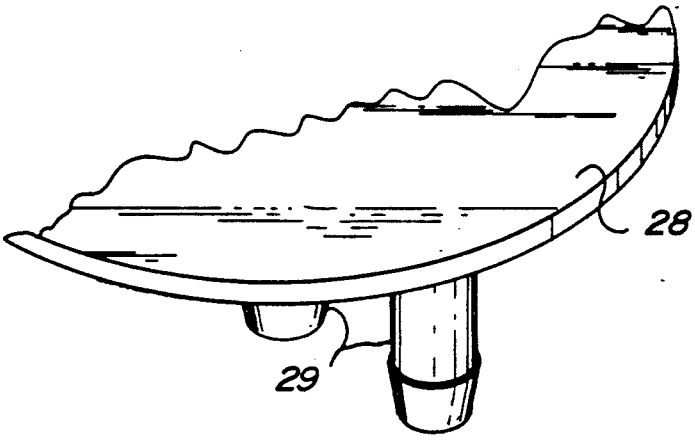
FIG. 6 is an isometric illustration of section 6 as set forth in FIG. 5.
Figure 7:
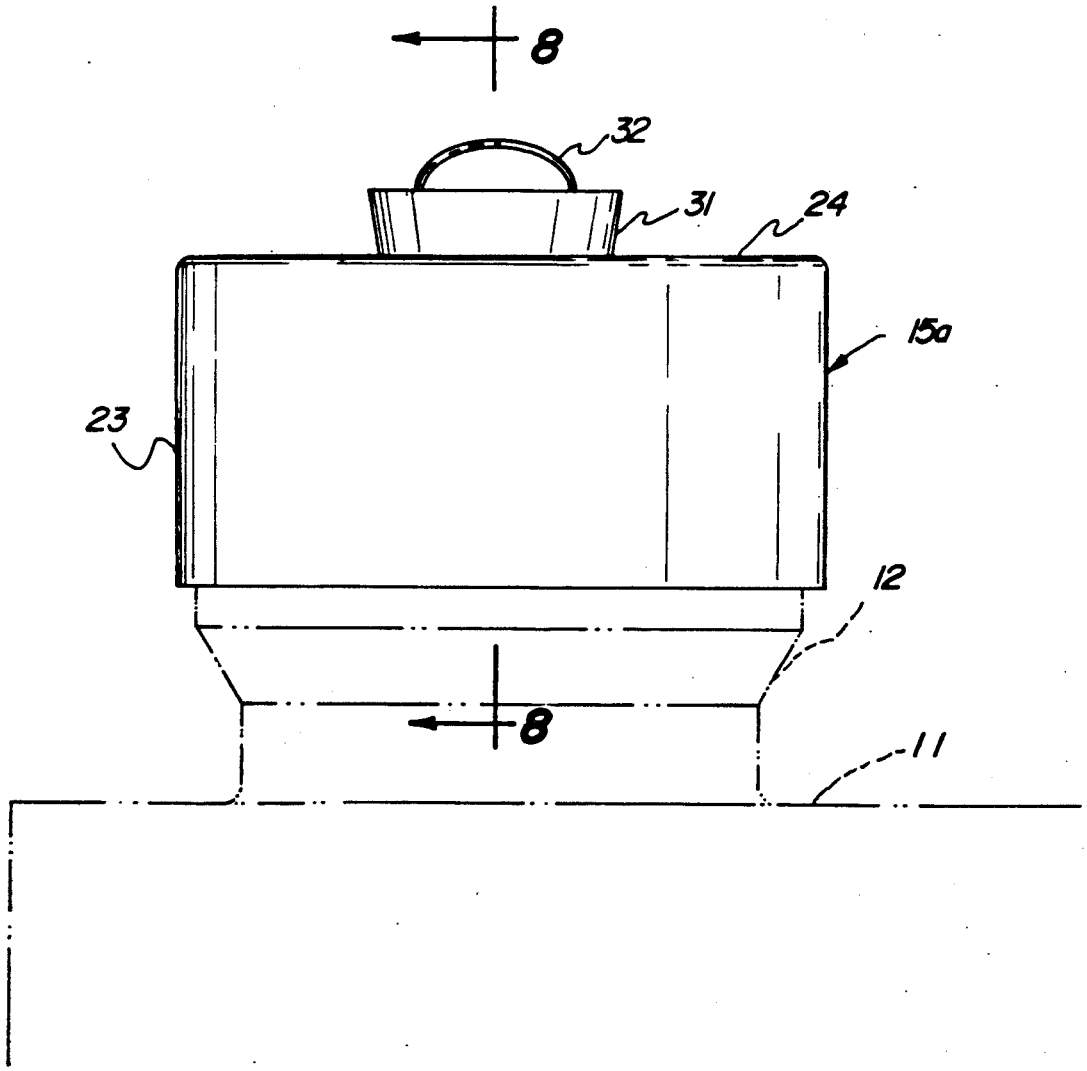
FIG. 7 is an orthographic view of a modified closure cap of the invention.
Figure 8:
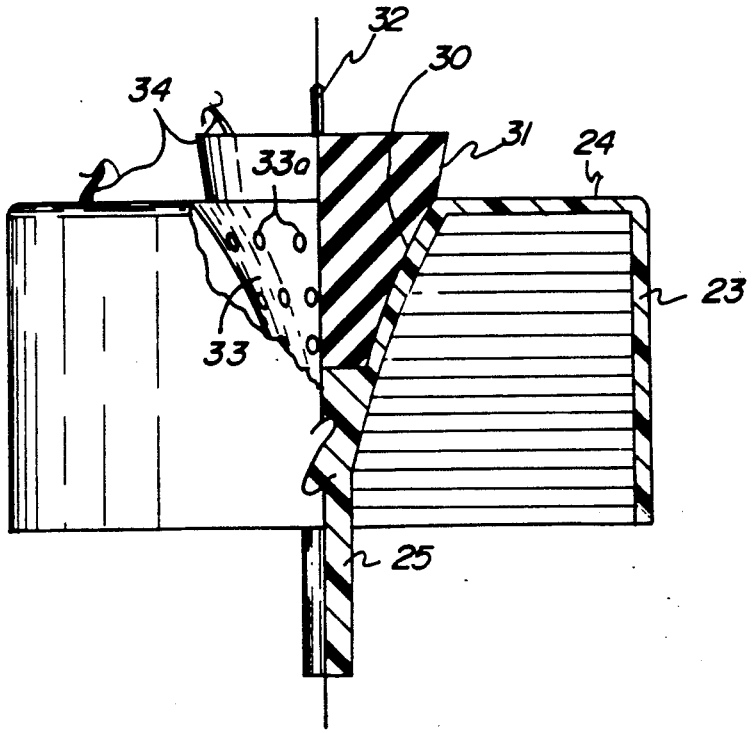
FIG. 8 is an orthographic view, taken along the lines 8—8 of FIG. 7, partially in section, in the direction indicated by the arrows.
Figure 9:
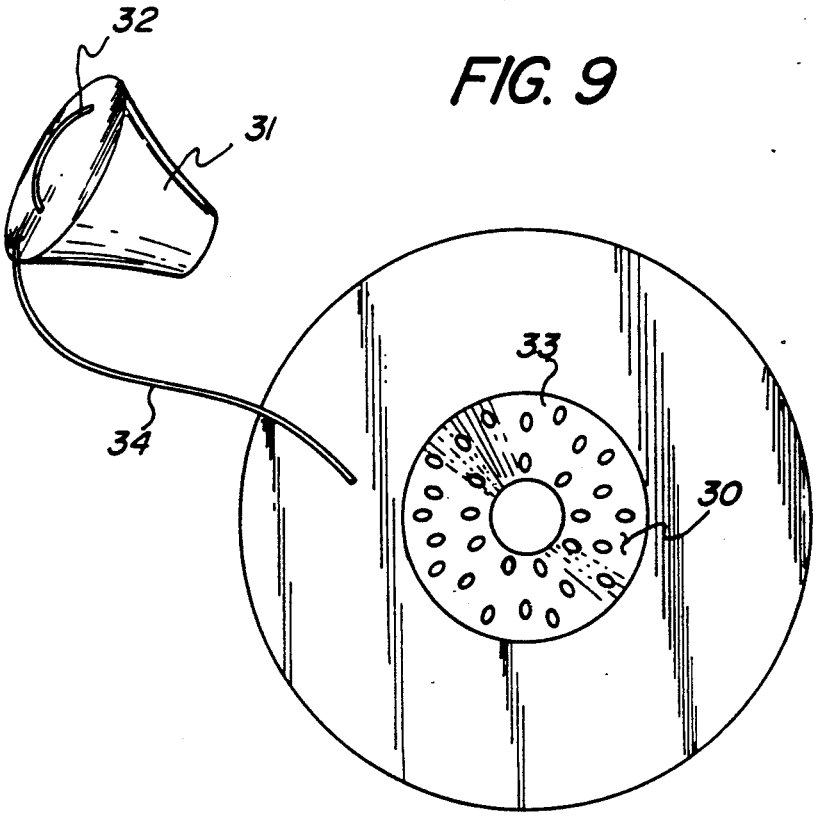
FIG. 9 is an orthographic top view of the modified closure cap.

The FIGS. 5–7 illustrate the use of a modified closure member 14*a* and associated modified spout cap 15*a*. The modified closure member 14*a* includes the construction, as set forth with reference to FIG. 1, but wherein the cylindrical head 16 includes a matrix defined by a plurality of through-extending bores 27 directed through the cylindrical head 16 extending through to the planar bottom surface 17 to permit fluid flow therethrough. A cylindrical head cap plate 28 is provided, including a plurality of plate plugs 29, wherein the predetermined number of through-extending bores 27 is equal to the predetermined number of plate plugs 29 to permit selective closure and cessation of fluid flow through the bores 27.

The modified spout cap 15*a* is formed to include a cap top wall central conical opening 30 directed through the cap top wall 24, wherein a conical plug 31 is received within the conical opening 30 to prevent fluid flow therethrough. The positioning leg 25 coaxially extends from the cap top wall 24 a predetermined distance in reference to the spout cap 15 to limit displacement of the closure member 14 from the seat 13. If desired, the positioning leg 25 may be shortened to permit displacement of the cylindrical head 16 relative to the seat 13 to enhance fluid flow in addition to the through-extending bores 27. The conical plug 31 is formed with a plug handle 32 to permit ease of manual manipulation of the plug relative to the conical opening 30, wherein a tether line 34 secures the plug to the cap top wall 24. Further, the central conical opening 30 is in communication with a surrounding conical wall 33 formed with a matrix of conical wall apertures 33*a* directed therethrough where fluid flow is permitted through the bores 27 and subsequently through the conical wall apertures 33*a* when the conical plug 31 is removed relative to the conical opening 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container closure, comprising, a container, the container including a container spout defined by a predetermined diameter, wherein the spout includes a spout upper end defining an upper distal end of the container spout, and a torroidal seat formed within the spout spaced below the spout upper end and spaced above the container, wherein the spout is defined about a spout axis, and a closure member, the closure member mounted within the spout, including a cylindrical head defined by a cylindrical head diameter less than the predetermined diameter of the spout, wherein the cylindrical head includes plural pairs of lobes fixedly mounted to the cylindrical head positioned below the cylindrical head and oriented within the container below the spout, wherein the cylindrical head is mounted on the torroidal seat in a first position and displaced from the torroidal seat in a second position, and the plural pairs of lobes are spaced from the cylindrical head a predetermined spacing, and wherein the torroidal seat is spaced from the container a predetermined length, wherein the predetermined length is less than the predetermined spacing, and the cylindrical head includes a planar bottom surface, and further includes a planar top surface, the planar top surface further including a beveled peripheral surface extending from the planar top surface to the peripheral edge of the cylindrical head, and further including a first vane coaxially and orthogonally mounted to the planar bottom surface, and a second vane orthogonally oriented relative to the first vane integrally and coaxially mounted to the planar bottom surface, wherein the plurality of lobes includes a first pair of lobes coplanar relative to one another and coplanar with the first vane, and the second vane including a plurality of second lobes orthogonally oriented relative to the first lobes, wherein the second lobes are coplanar relative to one another and to the second vane extending on diametrically opposed sides of the second vane within the container, and a spout cap, the spout cap including a cylindrical head, and including a planar top wall, and the top wall including a positioning leg fixedly mounted to the top wall extending within the cylindrical cap head, wherein the planar top surface of the cylindrical head is spaced from the spout upper end a predetermined distance and wherein the positioning leg is spaced from the bottom surface of the cap top wall a distance equal to the predetermined distance, and the cylindrical head of the closure member includes a matrix of through-extending bores directed therethrough defined by a predetermined number, wherein a cylindrical head cap plate is selectively securable to the cylindrical head of the closure member, wherein the cylindrical head cap plate includes a plurality of plate plugs extending orthogonally and downwardly relative to the cap plate, wherein the plate plugs are defined by the predetermined number and are arranged for reception within the through-extending bores to effect selective cessation of fluid flow through the through-extending bores.

2. A closure as set forth in claim 1 wherein the spout cap includes a cap top wall central conical opening directed coaxially through the cap top wall, and a conical plug selectively mounted within the conical opening, and the conical opening including an apertured conical wall in surrounding relationship relative to the conical opening, wherein removal of the conical plug relative to the conical opening permits fluid flow through the apertured conical wall.

3. A closure as set forth in claim 2 including a tether line mounted to the conical plug and to the cap top wall.

* * * * *